US006832558B2

(12) United States Patent
Weber et al.

(10) Patent No.: US 6,832,558 B2
(45) Date of Patent: Dec. 21, 2004

(54) RIDING RAIL TIE PLUGGING APPARATUS

(75) Inventors: Robert M. Weber, Wadsworth, IL (US); Donald Christopher Noll, Brookfield, WI (US); Leary Peterson, Franklin, WI (US); David Sean Johnsen, Wauwatosa, WI (US)

(73) Assignee: Nordco Inc., Oak Creek, WI (US)

( * ) Notice: Subject to any disclaimer, the term of this patent is extended or adjusted under 35 U.S.C. 154(b) by 21 days.

(21) Appl. No.: 10/269,214

(22) Filed: Oct. 11, 2002

(65) Prior Publication Data

US 2004/0069179 A1 Apr. 15, 2004

(51) Int. Cl.[7] ..... E01B 29/00
(52) U.S. Cl. ..... 104/2; 104/17.1
(58) Field of Search ..... 104/17.1, 17.2, 104/2, 16; 105/86; 221/9, 10, 294

(56) References Cited

U.S. PATENT DOCUMENTS 3,144,835 A 8/1964 Pehoski et al. ..... 104/17
4,393,784 A 7/1983 Theurer ..... 104/2
4,522,127 A 6/1985 Miller et al. ..... 104/17
4,966,516 A * 10/1990 Vartanian ..... 414/537
5,206,962 A * 5/1993 Thorwaldson ..... 4/323
5,265,379 A * 11/1993 Panetti ..... 451/11
5,636,574 A 6/1997 Pierrot ..... 104/17.1
6,425,450 B1 * 7/2002 Lansberry ..... 180/9.36
6,598,537 B2 * 7/2003 DeLucia et al. ..... 104/2

* cited by examiner

*Primary Examiner*—Frantz F. Jules
(74) *Attorney, Agent, or Firm*—Greer, Burns & Crain, Ltd.

(57) ABSTRACT

A riding rail tie plugging apparatus for plugging spike holes in ties on a railroad track includes a frame provided with wheels for supporting and moving the frame along the track. At least one reservoir is disposed in operational relationship to the frame for dispensing a supply of chemical tie-plugging solution. At least one applicator gun is in fluid communication with the at least one reservoir for dispensing the solution into the holes. At least one operator station is on the frame in operational relationship to the track and to the at least one applicator gun so that the at least one applicator gun is directly positionable by an operator disposed at the station for dispensing the epoxy solution into selected ones of the holes.

20 Claims, 3 Drawing Sheets

RIDING RAIL TIE PLUGGING APPARATUS

BACKGROUND OF THE INVENTION

The present invention relates generally to maintenance equipment used on railway track, and more specifically to such equipment used to plug tie holes on wooden railway track ties.

When reconditioning a railway track, it is customary to remove a selected one of the rails, together with the supporting tie plates and spikes, while retaining the other rail on the track for the use by, and support of, maintenance equipment, and to preserve the integrity and/or alignment of the track. Upon removal of the spikes, spike holes remain in the wooden ties and must be plugged to facilitate the relaying of a new rail, or portions of old rail as desired. Typically, the replacement rails and tie plates are fastened to the ties using the same holes. Thus, the holes must be properly plugged to accept and retain a new spike.

One approach to tie plugging has been to provide a supply of wooden plugs to a crew of workers, who then proceed to hammer the plugs into the holes. This is a time consuming and laborious process, and often the plugs are split or cracked during application, which further delays the process. Also, after time, it has been found that the wooden plugs do not satisfactorily retain the spikes, and the spikes work themselves loose when subject to the vibration and other forces generated by passing trains. Also, there is an ongoing movement in the railway maintenance industry to eliminate manual maintenance operations wherever possible.

Another solution to the tie-plugging problem has been to dispense an epoxy solution into the holes. This operation is commonly known as chemical tie plugging. Upon setting, the epoxy hardens and provides a new site for application of a spike. Chemical tie plugging has been accomplished using a movable rail maintenance platform holding at least one chemical reservoir, to which is connected at least one applicator gun. The platform may be towed or is self-propelled along the track.

Preferably two or more operators walk the track behind the platform and hold the applicator guns, which are suspended behind the platform. As the platform moves along the track, the operators follow behind and manually position the applicator guns over the holes and actuate the guns to dispense the epoxy, usually under pressure. A disadvantage of this arrangement is that the operators become fatigued after long stretches of track work of this type. Also, the rate of tie plugging is dependant upon the walking pace of the operators. In many situations, the tie plugging operation becomes a bottleneck for the other components of the railway maintenance gang.

U.S. Pat. No. 5,636,574 discloses a rail tie-plugging machine having a work location for a single operator, a complicated storage bin, a conveyor, a centrifugal feeder and a remotely actuated inserter gun. This device also includes a tie sensing mechanism connected to the inserter gun for automatically locating the gun over a desired position on the tie. Tie plugs must be sorted from bulk and positioned for transfer to an elongate feed tube connected to the inserter. This machine is configured for bulk handling and sequentially dispensing wooden tie plugs, which as described above, have several disadvantages.

Thus, there is a need for a rail tie plugging apparatus which dispenses epoxy solution for chemical plugging of ties, and provides for the operators to ride on the machine while inserting the solution. Also, there is a need for such a machine which allows for more rapid tie hole plugging while minimizing operator fatigue.

BRIEF SUMMARY OF THE INVENTION

The above-listed objectives are met or exceeded by the present riding rail tie plugging apparatus, which features at least one and preferably two operator stations on a preferably self-propelled frame. The operators are positioned close to the ties for effective tie plugging, and, from the operator stations may also control the forward movement of the machine along the track during travel (nonworking) time. A chemical application apparatus is provided for dispensing chemical tie-plugging solution to at least one applicator gun. The construction and arrangement of the present machine is such that the operators may comfortably hold the applicator guns while plugging the holes. The apparatus also features a rotating operator seat enabling the operator to readily access ties to be plugged, regardless of the direction of travel, as well as controlling the movement of the apparatus along the track.

More specifically, the present invention provides a riding rail tie plugging apparatus for plugging spike holes in ties on a railroad track, including a frame being provided with a plurality of wheels for supporting the frame for movement upon the track. At least one reservoir is disposed in operational relationship to the frame for dispensing a supply of chemical tie-plugging solution. At least one applicator gun is in fluid communication with the at least one reservoir for dispensing the solution into the holes. At least one operator station is disposed on the frame in operational relationship to the track and to the corresponding applicator gun so that the at least one applicator gun is directly positionable by an operator disposed at the station for dispensing the solution from the at least one reservoir into selected ones of the holes.

DETAILED DESCRIPTION OF THE INVENTION

Figure 1:
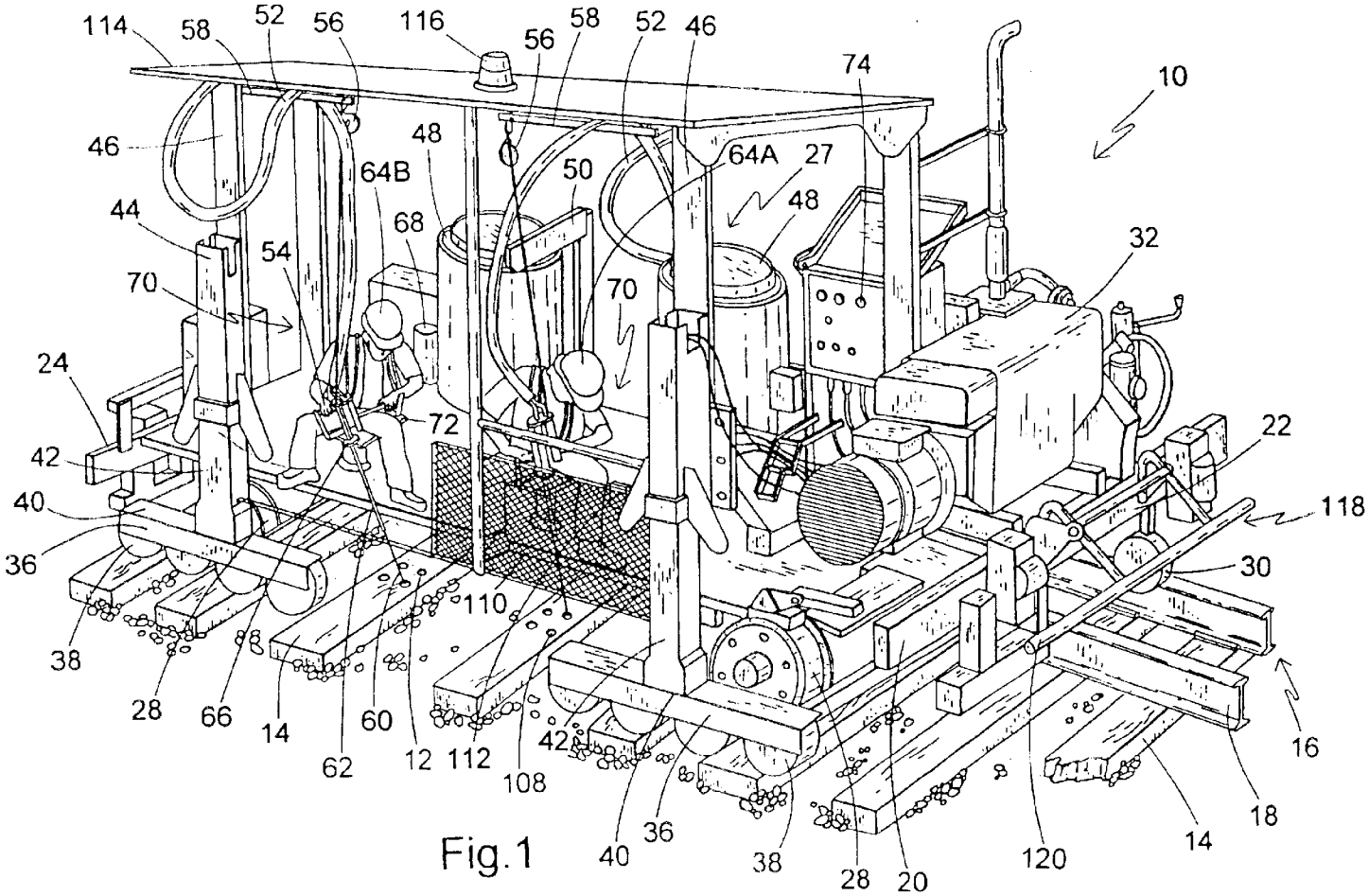
FIG. 1 is a perspective view of the present tie plugging apparatus shown with two operators.

Referring now to FIG. 1, a rail tie plugging apparatus incorporating the invention is generally designated 10, and is designed for use in plugging spike holes 12 found in ties 14 of a railroad track, generally designated 16, from which one rail 18 has been removed for maintenance or reconditioning. The apparatus 10 includes a frame 20 having a first or forward end 22 and a second or rear end 24. Depending on which of the rails 18 of the track 16 is being worked on, the apparatus 10 will travel in different directions. Depending on the direction of travel of the rail maintenance gang of which the apparatus or machine 10 is a part, either ends 22 or 24 may be the forward-most end. Also included on the frame 20 is a pair of main cross members 26 (best seen in FIG. 2) between which the maintenance operations of the apparatus are performed. The number, location and configuration of the cross members 26 may vary to suit the application. A work area 27 is defined between the frame ends 22, 24, and preferably between the cross members 26.

A plurality of wheels 28 are provided for supporting the frame 20 for movement upon the track 16 and four such rail flange wheels are provided. In situations where one of the rails 18 is removed, the apparatus 10 will be supported by the two wheels 28 on the remaining rail, and at least one flanged guide roller or wheel 30. A source of motive power 32, which in the preferred embodiment is a diesel engine, is provided for moving the frame 20 along the track 16. Other types of engines or motors are contemplated. It is also contemplated that the frame 20 may be provided without motive power, in which case it will be towable by another vehicle.

In situations where one of the rails 18 of the track is removed, the apparatus 10 is supported on the rail bed (the ties 14 and the supporting rock ballast 34) by at least one and preferably two crawler assemblies 36, each including a plurality of linearly arranged crawler wheels 38 rotatably secured in a crawler frame 40. Each of the crawler frames 40 is pivotably secured to a main guide rod 42 which is slidably secured within a crawler tower 44. The crawler towers 44 are secured to upright frame members 46, and a fluid power system (not shown) controls the reciprocal movement of the guide rods 42 relative to the crawler towers. Prior to tie hole plugging, the crawler towers 44 are actuated to lower the guide rods 42 and the associated crawler frames 40 until the crawler wheels 38 are in contact with the rail bed. The frame 20 is thus supported on the side where the rail 18 has been removed.

The frame 20 is provided with at least one and preferably two chemical reservoirs 48 constructed and arranged for retaining a supply of epoxy solution (not shown) or other settable chemical tie-plugging solution suitable for plugging the holes 12 in the wooden ties 14 under pressure. Since the two reservoirs 48 and their associated equipment are virtually identical, only one will be described. Each of the reservoirs 48 is preferably secured to the frame 20 by attachment to a subframe 50, however it is contemplated that the reservoirs need only be in operational relationship to the frame 20, and as such may optionally be provided on a separate, powered or towed vehicle or cart and configured to be in fluid communication with corresponding components on the frame as described below. Epoxy solution is fed from the reservoir 48 under pressure through a flexible feed line 52 to an associated applicator gun 54. To reduce operator fatigue and also reduce strain on the feed line 52, the feed line is suspended from the frame 20 using a retractable reeled cable 56 connected to a pivoting support boom 58. The boom 58 pivots about or slides along a generally vertical axis associated with one of the upright frame members 46.

As is known in the art, each applicator gun 54 is in fluid communication with a supply of chemical hardener solution (not shown) which is mixed with the epoxy solution on the gun at a dispensing outlet 60. The final mixing of solutions is postponed as long as possible along the chemical transfer conduit to avoid the premature setting of solution within the gun 54. In the preferred embodiment, a static mixer 62 is provided to mix the epoxy and hardener prior to their insertion into the hole 12. However, other equivalent mixing technologies known in the art are contemplated. Each operator 64 controls the dispensing of solution from the applicator gun using a trigger 66 as is known in the art. In some applications, the trigger 66 is provided with a time dispense feature controlling the timing and the amount of material dispensed. At the conclusion of an application shift or session, a flush or purge tank 68 filled with a solvent is pumped manually or automatically through the gun 54 to remove any remaining epoxy and/or hardener solution.

At least one operator station, generally designated 70 is disposed on the frame 20 in operational relationship to the track 16 and to at least one of the applicator guns 54 so that the gun is directly positionable by the operator 64 disposed at the station for dispensing the epoxy solution into selected ones of the holes 12. As discussed above, there are preferably two such stations 70, both of which are preferably located in the work area 27, however the number of stations may vary to suit the application. Also, it is contemplated that at least one of the stations is in the work area 27, and the other may be located elsewhere on the frame 20. As described in greater detail below, there are particular advantages to providing two stations 70 for working on the location of a single rail 18 at a time.

One advantage of the operator station 70 is that it is located on the frame 20 between the cross members 26. This location provides good visual access to the tie holes 12 which is unobstructed by operational components of the apparatus 10, including the reservoir 48 and the engine 32. In addition, the operator 64 can easily rotate to directly or indirectly control the movement of the apparatus 10 along the track 16.

A feature of the present operator station 70 is a seat 72 located in the station is rotatably mounted to the frame 20, and that the seat is rotatable between a working position and traveling position. In the particularly preferred embodiment, the seat 72 is rotatable about a 360° arc in an incremental fashion. This rotatability allows the operator to easily position himself for efficiently operating the applicator gun 54 to accurately fill the tie holes while reducing fatigue as much as possible. Regarding the latter factor, the seat 72 is disposed on the frame 20 in the operator station 70 so that the applicator gun 54 can rest in the operator's lap (best seen in FIG. 1).

In the traveling position (FIG. 2), the seat 72 is rotatable towards the first or forward end 22 of the frame 20 to better monitor the progress of the apparatus down the track 16. In addition, when in the traveling position, the operator has access to a control system 74 disposed on the frame 20 and connected to the engine 32 for controlling the movement of the frame along the track. The precise construction of the control system 74, including throttle adjustment for the engine 32 and braking controls (not shown), are available on many such rail maintenance vehicles and as such is not discussed in detail in the present application.

Figure 4:
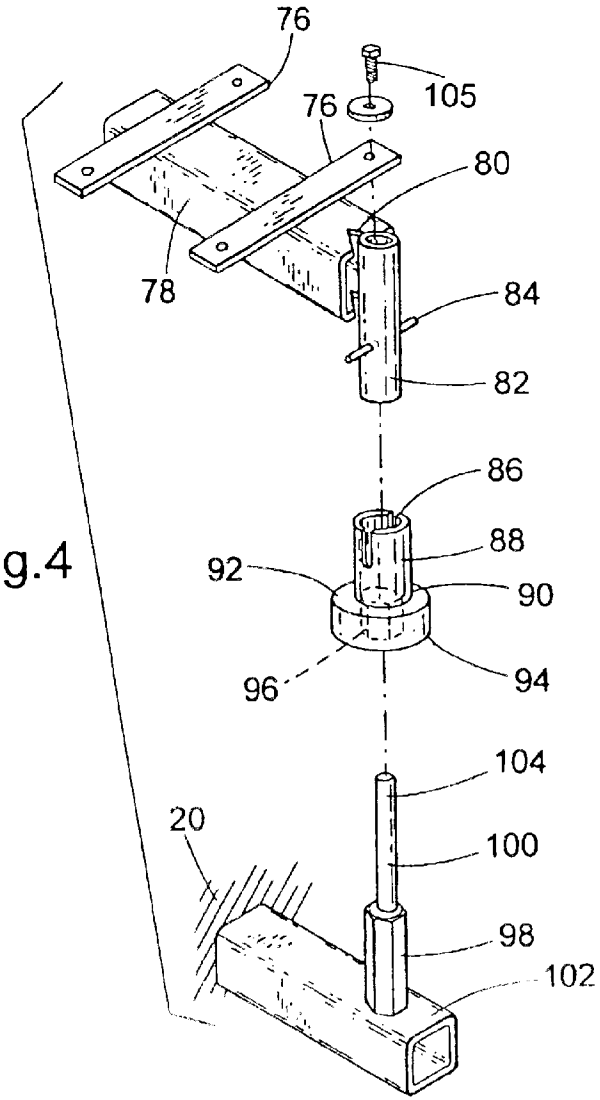
FIG. 4 is a fragmentary exploded perspective view of the seat swivel of the present apparatus.

Referring now to FIG. 4, the incremental rotatability of the present operator station seat 72 will be described in greater detail. The seat 72 is secured on its underside to at least one and preferably two spaced, generally parallel seat support bars 76, which in turn are attached to a main seat support member 78 using known fastening technologies (welding, threaded fasteners, rivets, chemical adhesives or the like). At one end, the main seat support member 78 is provided with a notch or elongate, generally vertically projecting recess 80 which is configured for receiving a seat pedestal tube 82. Preferably, the seat pedestal tube 82 is fixed in the notch 80 using known fastening technologies, and is sufficiently long to depend from the main seat support member 78.

A guide pin 84 is transversely mounted in the pedestal tube 82, for example, through a throughbore, and projects transversely past the pedestal tube. The guide pin 84 is received in a guide slot 86 in a barrel portion 88 of a faceted washer 90. Below the barrel portion 88, the washer 90 is provided with a radially projecting shoulder 92 having a depending skirt 94. An underside of the shoulder 92 and the skirt 94 is configured in a plurality of drive-socket-like facets 96 (shown hidden). These facets 96 engage a hex-shaped lower end 98 of a swivel axis rod 100 which in turn is attached to a seat cross-member 102 of the frame 20.

An upper end 104 of the swivel axis rod 100 is radially reduced in size to guide and matingly locate upon the tubular pedestal tube 82. The upper end 104 is sufficiently reduced in diameter to provide a pivot axis for the pedestal tube 82 and accommodates the presence of the transverse guide pin 84.

In operational engagement, the facets 96 of the washer 90 matingly engage the hex-shaped lower end 98 of the axis rod 100. The seat 72 is then disposed in a desired point along its incremental position arc. When the operator decides to move the position, he merely lifts up the washer 90, which disengages the seat 72 from the hex-shaped lower end 98, and rotates the seat to the newly desired location. The washer 90 is then lowered to a new mating engagement of the hex-shaped lower end 98 and the axis rod 100. The seat 72 is thus incrementally adjustable around the entire 360° arc having the seat pedestal tube 82 as its axis. The seat assembly, including items 82, 90 and 104 is preferably secured together by a threaded fastener 105, most preferably a threaded screw with a washer, which engages a threaded recess (not shown) in the upper end 104, and secures the seat pedestal tube 82 and the faceted washer 90.

Figure 3:
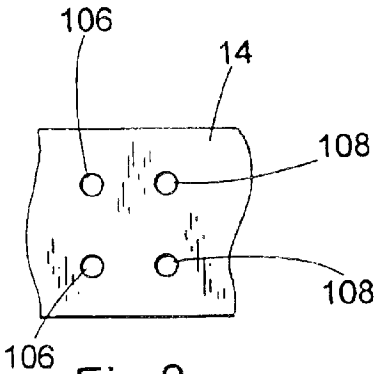
FIG. 3 is a fragmentary overhead plan view of a rail tie showing the holes to be plugged.

Referring now to FIGS. 1 and 3, another feature of the present apparatus 10 is that when the preferred arrangement of two side-by-side operator stations 70 is provided, production of the apparatus is increased, in that the two operators 64 can work together in plugging the holes 12 of a particular tie 14. It will be noted that each tie end is provided with at least one and preferably two inner holes 106, and at least one and preferably two outer holes 108. By providing two operator stations 70, the first operator 64*a* can work on a selected one of the inner or outer holes 106, 108, and the second operator 64*b* can work on the other of the inner and outer holes. Thus, the operators 64*a*, 64*b* disposed at the side-by-side stations 70 may sequentially dispense the epoxy solution into the same tie 14.

Figure 2:
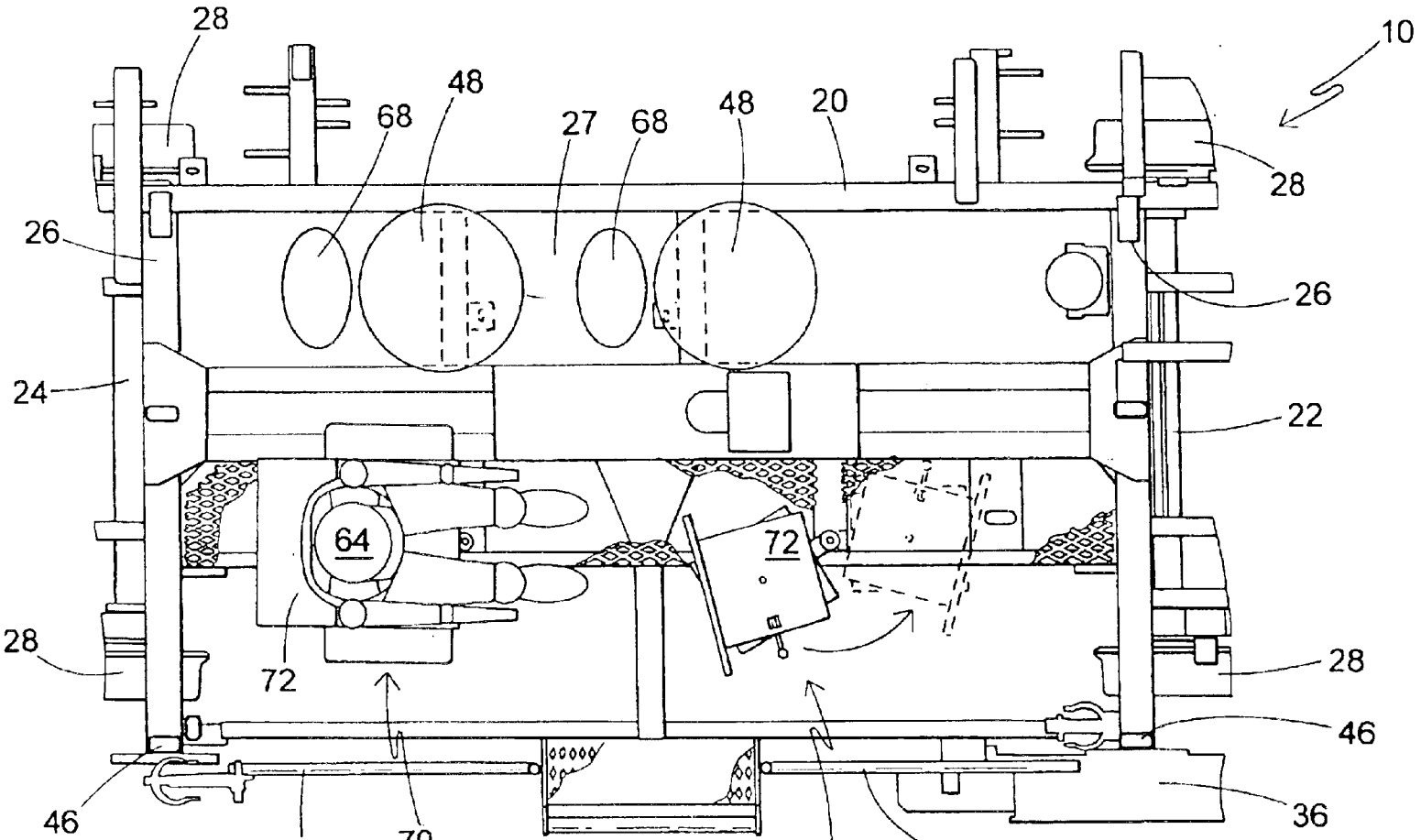
FIG. 2 is a fragmentary overhead plan view of the present apparatus.

Referring now to FIGS. 1 and 2, another feature of the present apparatus 10 is that visual and operational access to the ties 14 is enhanced through the provision of at least one retractable floor panel 110. Preferably two such panels 110 are provided, however the number and configuration of the panels may vary to suit the application. Also, the panels 110 are provided with a metal mesh floor, but it is contemplated that other materials may be used, including solid panels of various rigid materials (metal, plastic, wood) or metal diamond plate, known in the art.

Each of the panels 110 is hingably attached to the frame 20 so that when in a lowered position, the operators 64 may easily access the operator stations 70. Once the tie plugging operation begins, the floor panels 110 may be pivotably retracted to provide ready access to the ties 14 (best seen in FIG. 1). It is also preferred that at least one latch 112 is provided to hold the corresponding elevated panel 110 in the retracted position while the tie-plugging operation is conducted.

Referring again to FIG. 1, the apparatus 10 is preferably provided with other equipment as is commonly known in rail maintenance devices. For example, a canopy or roof 114 is supported above the work area 27 by the upright frame members 46. A warning light 116 is mounted upon the roof 114. At the first and second ends 22, 24 of the frame 20, a pivoting brake bar assembly 118 is connected to the control system 74 so that when a brake bar 120 is depressed, the control system 74 applies the brakes to the wheels 28 and disables the crawler wheels 38. Also, each of the operator seats 72 is connected to the control system 74 so that when one of the operators 64 stands up off the seat, the control system 74 applies the brakes to the wheels 28 and disables the crawler wheels 38 as described above.

Thus, it will be seen that the present apparatus provides a riding rail tie plugging apparatus which addresses many of the needs of rail maintenance practitioners. Using the present apparatus, rail tie holes may be more quickly and accurately plugged with epoxy solution or other chemicals for quickly filling and plugging the existing tie holes. By providing the operators a place to ride on the machine while working, the level of operator fatigue is significantly reduced, increasing operator efficiency. Also, when more than one operator is located in side-by-side orientation, the tie plugging operation can progress more quickly and can thus keep up with other rail maintenance equipment in a typical maintenance gang.

While a particular embodiment of the riding rail tie plugging apparatus of the invention has been described herein, it will be appreciated by those skilled in the art that changes and modifications may be made thereto without departing from the invention in its broader aspects and as set forth in the following claims.

What is claimed is:

1. A riding rail tie plugging apparatus for plugging spike holes in ties on a railroad track, comprising:

a frame having a defined work area, said frame being provided with at least two opposed pairs of wheels for supporting said frame for movement upon the track;

at least one reservoir disposed in said work area on said frame for dispensing a supply of chemical tie-plugging solution;

at least one applicator gun located in said work area in fluid communication with said at least one reservoir for dispensing the solution into the holes;

at least one operator station disposed on said frame in said work area in operational relationship to the track and to said at least one applicator gun so that said at least one applicator gun is directly positionable by an operator disposed a said station for dispensing the solution into selected ones of the holes; and said work area being located between opposed pairs of said wheels on said frame.

2. The apparatus of claim 1 further including a pair of said operator stations so that the operators disposed at said stations may sequentially dispense the solution into the same tie.

3. The apparatus of claim 1 further including a source of motive power for moving said frame along the track, and a control system for controlling said source of motive power, wherein said control system is constructed and arranged to be accessible from said at least one operator station.

4. The apparatus of claim 1 wherein said frame includes a floor with at least one retractable floor panel in operational relationship with said at least one operator station for providing enhanced access to the holes.

5. The apparatus of claim 4 further including releasable latch for securing said at least one retractable floor panel in an elevated position for providing access to the holes.

6. The apparatus of claim 1 wherein said at least one applicator gun is connected to said at least one reservoir by a flexible hose, and is constructed and arranged to be restable in an operator's lap during operation.

7. The apparatus of claim 1 wherein said at least one operator station includes a seat which is rotatably mounted to said frame.

8. The apparatus of claim 7 wherein said seat is rotatable between a working position and traveling position.

9. The apparatus of claim 7 wherein said sea is incrementally movable in a 360° arc.

10. The apparatus of claim 1 further including at least one retractable crawler assembly.

11. The apparatus of claim 1 wherein said at least one reservoir is equipped with a flush tank for cleaning said at least one applicator gun of the solution.

12. The apparatus of claim 1 further including at least one guide roller disposed on said frame for guiding said frame along the track when one rail of the track is removed.

13. The apparatus of claim 1 wherein each tie of the railroad track has at least one outer hole and at least one inner hole, and said frame is provided with two operator stations located in side-by-side relationship and constructed and arranged to provide the operator in a first said station with operational access to one of said at least one inner hole and said at least one outer hole, and the operator in a second said station with operational access to one of said at least one inner hole and said at least one outer hole.

14. The apparatus of claim 1 wherein said frame has a first end and a second end, and said at least one operator station is located between said ends.

15. The apparatus of claim 1 wherein said frame further includes two opposing pairs of upright frame members, and said work area is defined between said opposing pairs.

16. A riding rail tie plugging apparatus for plugging spike holes in ties on a railroad track, comprising:

a frame provided with a plurality of wheels for supporting said frame for movement upon the track, and a source of motive power for moving said frame along the track, said frame defining a work area provided with said source of motive power;

a control system in said work area connected to said source of motive power for controlling the movement of said frame along the track;

at least one reservoir disposed in said work area on said frame for dispensing a supply of chemical tie-plugging solution;

at least one applicator gun in said work area in fluid communication with said at least one reservoir for dispensing the solution into the holes;

at least one operator station disposed on said frame in said work area in operational relationship to the track and to said at least one applicator gun so that said at least one applicator gun is directly positionable by an operator disposed at said station for dispensing the solution into selected ones of the holes.

17. The apparatus of claim 16 further including a pair of said operator stations located in side-by-side relationship and defining a line generally parallel to the associated track so that operators disposed at said stations may sequentially dispense the solution into the same tie.

18. The apparatus of claim 16 wherein said frame includes a floor with at least one retractable floor panel in operational relationship with said at least one operator station for providing enhanced access to the holes.

19. A riding rail tie plugging apparatus for plugging spike holes in ties on a railroad track, comprising:

a single frame having a first cross member, a second cross member and a work area being defined therebetween, said frame being provided with a plurality of wheels for supporting said frame for movement upon the track;

at least one reservoir disposed in operational relationship said frame for dispensing a supply of chemical tie-plugging solution;

at least one applicator gun in fluid communication with said at least one reservoir for dispensing the solution into the holes;

at least one operator station disposed on said frame in said work area in operational relationship to the track and to said at least one applicator gun so that said at least one applicator gun is directly positionable by an operator disposed at said station for dispensing the solution into selected ones of the holes; and a source of motive power for moving said frame along the track, and a control system for controlling said source of motive power, wherein said control system is constructed and arranged to be accessible from said at least one operator station.

20. The apparatus of claim 19 further including a seat rotably mounted to said frame at each said operator station, said seat being rotatable in a 360° arc wherein said seat includes at least one seat support member connected to a depending faceted washer having a plurality of facets constructed and arranged to selectively matingly engage a vertically projecting faceted swivel axis rod secured to said frame for adjusting the position of said seat relative to said frame.

* * * * *